US011241085B2

(12) United States Patent
Taboh

(10) Patent No.: US 11,241,085 B2
(45) Date of Patent: Feb. 8, 2022

(54) SCRAPING APPARATUS

(71) Applicant: Elan Shimon Taboh, Petach Tikva (IL)

(72) Inventor: Elan Shimon Taboh, Petach Tikva (IL)

( * ) Notice: Subject to any disclaimer, the term of this patent is extended or adjusted under 35 U.S.C. 154(b) by 0 days.

(21) Appl. No.: 16/290,911

(22) Filed: Mar. 3, 2019

(65) Prior Publication Data

US 2019/0269292 A1 Sep. 5, 2019

Related U.S. Application Data

(60) Provisional application No. 62/638,161, filed on Mar. 4, 2018.

(51) Int. Cl.

| | |
|---|---|
| ***A46B 15/00*** | (2006.01) |
| ***A47L 13/08*** | (2006.01) |
| *B08B 1/00* | (2006.01) |

(52) U.S. Cl.

CPC ..... *A46B 15/0081* (2013.01); *A47L 13/08* (2013.01); *A46B 2200/302* (2013.01); *B08B 1/005* (2013.01)

(58) Field of Classification Search

CPC ..... A47L 13/02; A47L 13/022; A47L 13/08; A47L 13/12; A46B 15/0081; A46B 2200/302; A46B 17/08

USPC ..... 15/111, 143.1, 144.1, 144.3, 144.4; D4/118

See application file for complete search history.

(56) References Cited

U.S. PATENT DOCUMENTS

| | | | | |
|---|---|---|---|---|
| 2,741,788 | A * | 4/1956 | Shey | A47L 13/12 401/25 |
| 2,742,658 | A * | 4/1956 | Sproston | A47L 13/12 15/111 |
| 8,533,890 | B2 * | 9/2013 | Pannell | A47L 13/12 15/111 |
| 2018/0078031 | A1 * | 3/2018 | Mizrachi | A46B 17/00 |

* cited by examiner

*Primary Examiner* — Laura C Guidotti
(74) *Attorney, Agent, or Firm* — AlphaPatent Associates, Ltd; Daniel J. Swirsky

(57) ABSTRACT

A scraping apparatus, including: a gripping assembly, for gripping a stick of a cleaning tool; a bar, extending from the gripping assembly, the bar shaped to include a first section being adjacent and parallel to the broom stick, and a second section being adjacent and parallel to a brush of the broom; a scraping tip disposed at an end of the bar; and a location disposition mechanism, for manually allowing sliding the bar in relation to the broom stick and for manually disallowing the sliding against pressure applied on the scraping tip.

7 Claims, 7 Drawing Sheets

SCRAPING APPARATUS

CROSS-REFERENCE TO RELATED APPLICATIONS

This application claims the benefit of priority from U.S. Provisional Application No. 62/638,161, filed Mar. 4, 2018, the disclosure of which is incorporated herein by reference.

TECHNICAL FIELD

The invention relates to the field of household cleaning. More particularly, the invention relates to an apparatus for accompanying a broom.

BACKGROUND

There are many different types of brooms available for cleaning floors. Most have a relatively soft brush which frequently cannot remove debris which is stuck to the floor while sweeping. A scraper must then be used to loosen the debris from the floor prior to sweeping.

Connecting a scraping element requires significant force of holding together with providing friendly moving of the scraping element.

The purpose of the present invention is to provide a solution to the abovementioned problems.

SUMMARY

A scraping apparatus, including:
a gripping assembly;
a bar, extending from the gripping assembly;
a scraping tip; and
a location disposition mechanism.

BRIEF DESCRIPTION OF THE DRAWINGS

Embodiments, features, and aspects of the invention are described herein in conjunction with the following drawings.

The drawings are not necessarily drawn to scale.

DETAILED DESCRIPTION

The invention will be understood from the following detailed description of embodiments of the invention, which are meant to be descriptive and not limiting. For the sake of brevity, some well-known features are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Figure 1:
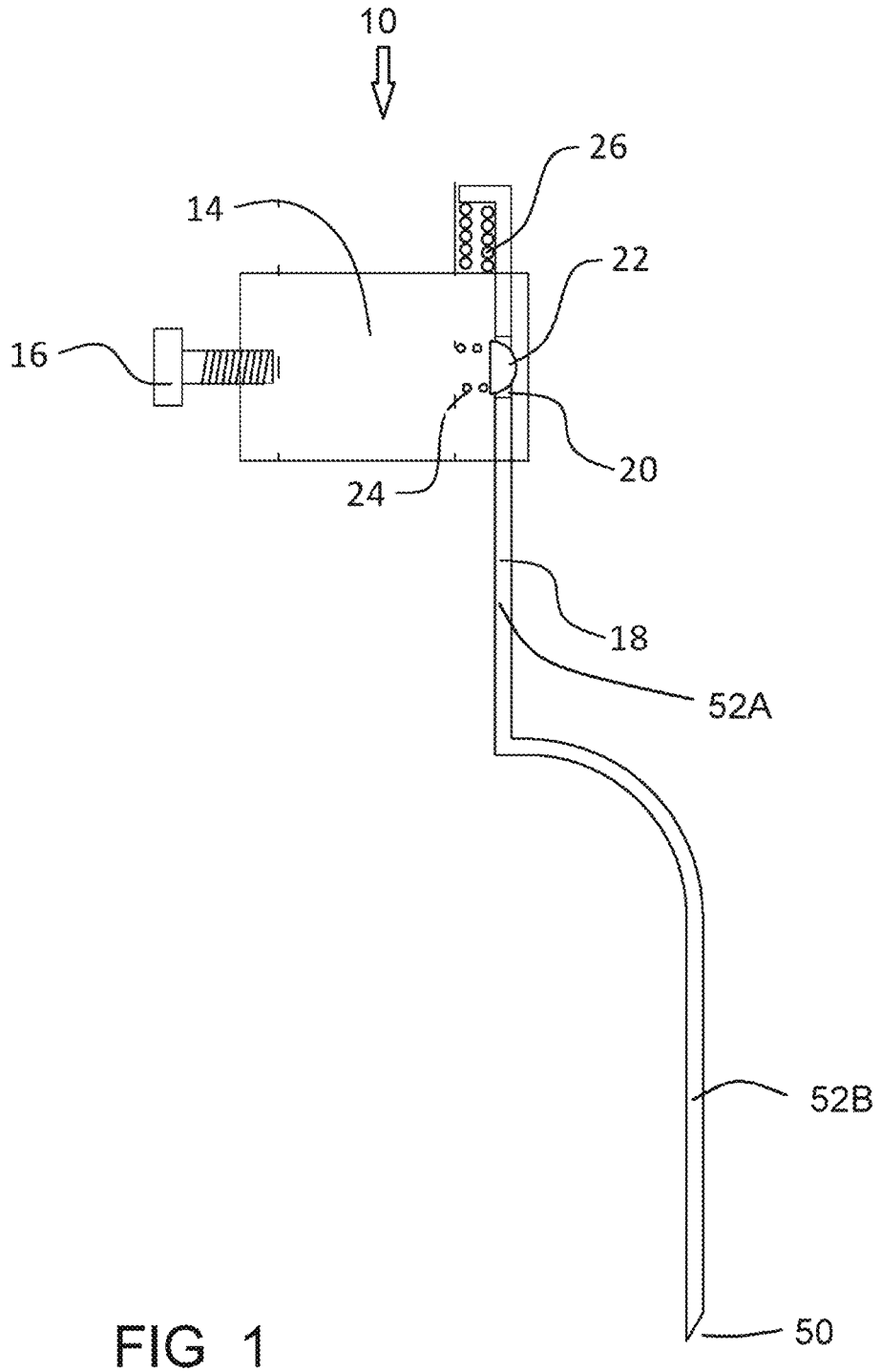
FIG. 1 is a side view of a scraping apparatus according to one embodiment of the invention.

FIG. 1 is a side view of a scraping apparatus according to one embodiment of the invention.

A scraping apparatus 10 according to one embodiment of the invention, includes a hollow cylinder 14, for gripping a broom stick (not shown); a bar 18, extending from hollow cylinder 14, and being slideable in relation to the broom stick; and a scraping tip 50, extending from bar 18.

Figure 2:
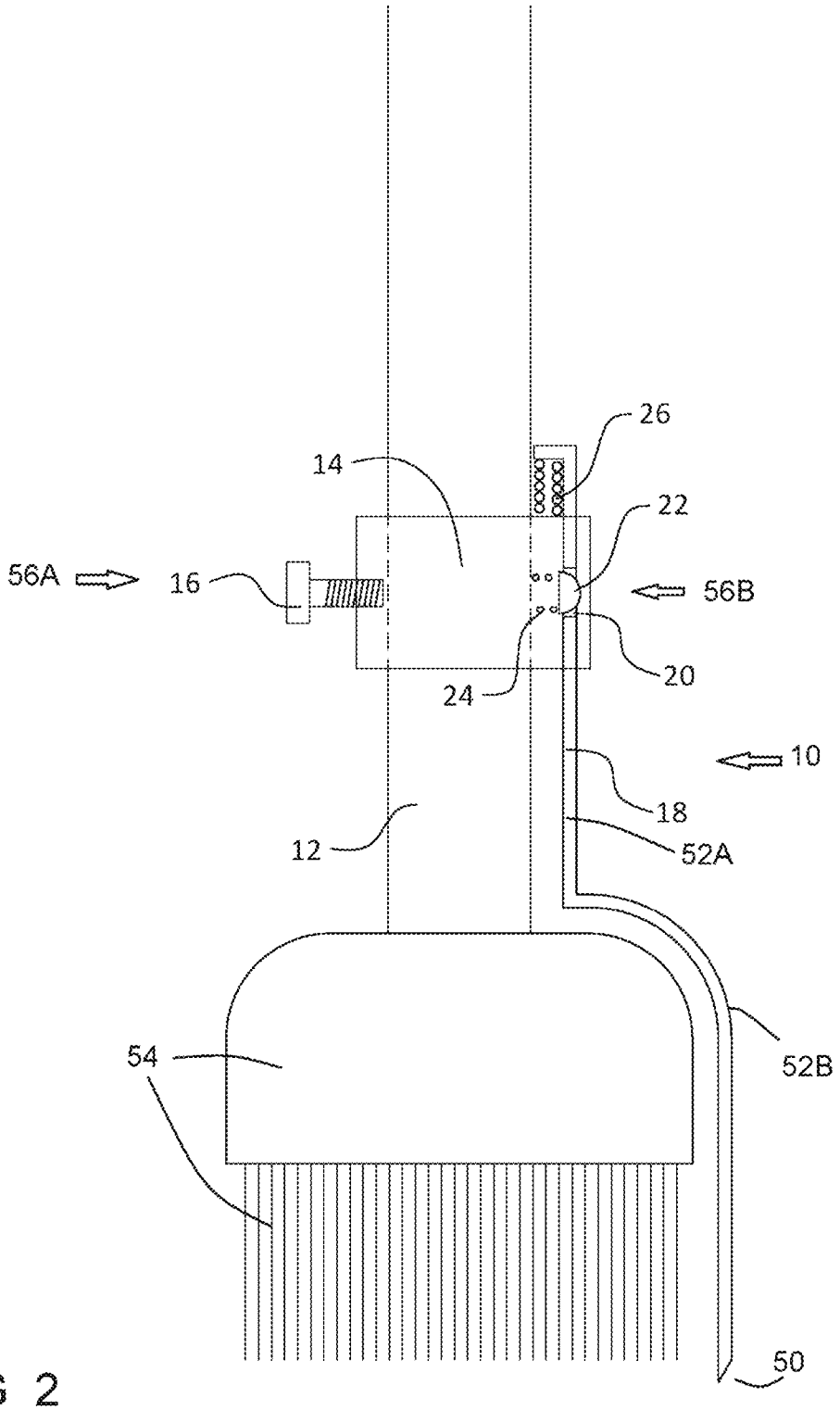
FIG. 2 is a side view of the scraping apparatus of FIG. 1, being connected to a broom.

FIG. 2 is a side view of the scraping apparatus of FIG. 1, being connected to a broom.

The term "broom stick" refers herein as well to a squeegee stick, or to any stick of a cleaning tool.

Bar 18 includes a straight section 52A, for being disposed near and parallel to the broom's stick 12; and a rounded section 52B, for being disposed near and parallel to the broom's brush.

Scraping apparatus 10 further includes at least one location disposition mechanism, for ascending and descending bar 18 in relation to broom stick 12.

A location disposition mechanism 56A constitutes a screw 16, for thrusting broom stick 12.

A location disposition mechanism 56B constitutes a hole 20, for housing a bolt 22, being pressed by a horizontal spring 24 at a low disposition of bar 18 against a vertical spring 26.

Figure 3:
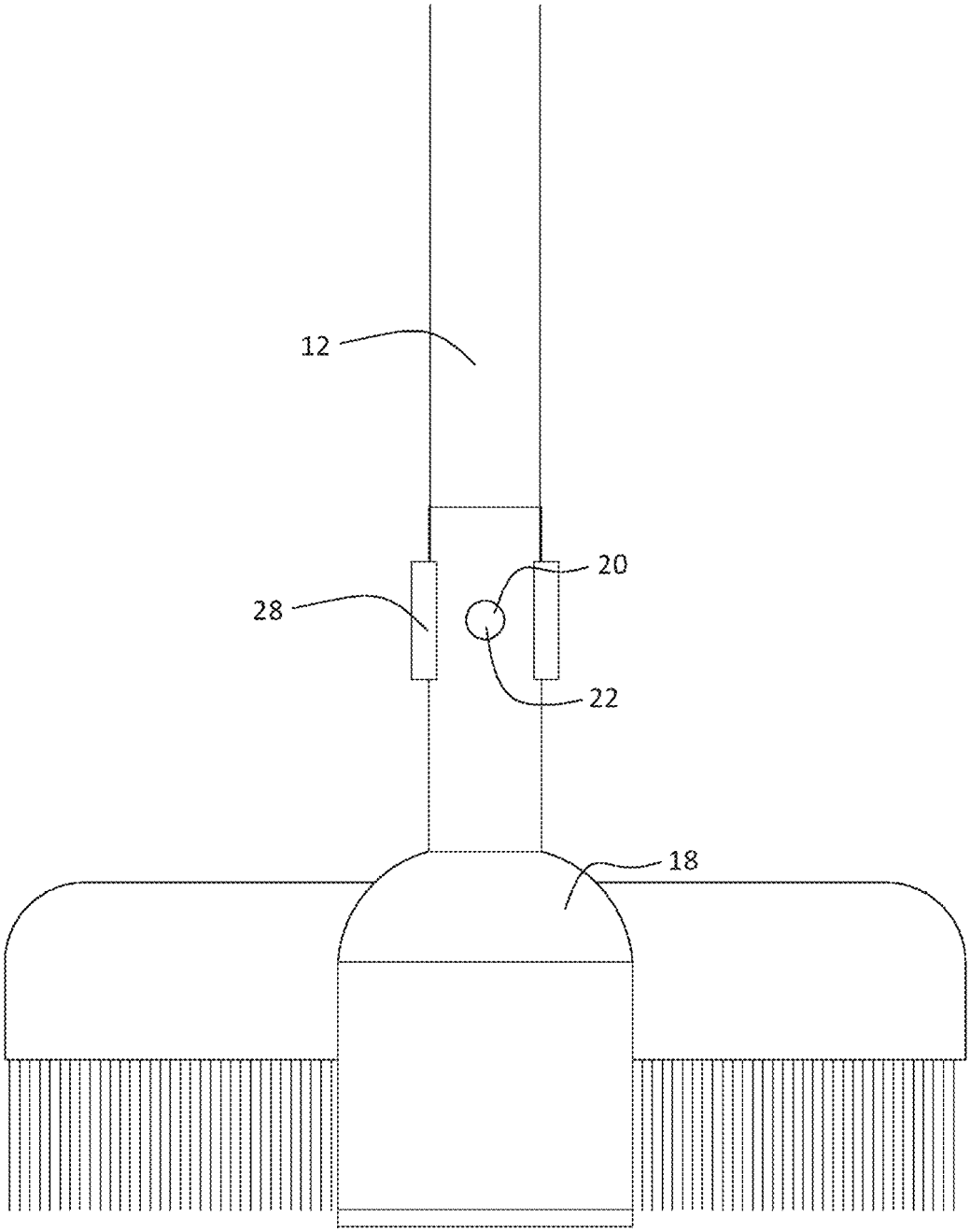
FIG. 3 is a front view of FIG. 2.

FIG. 3 is a front view of FIG. 2.

Figure 4:
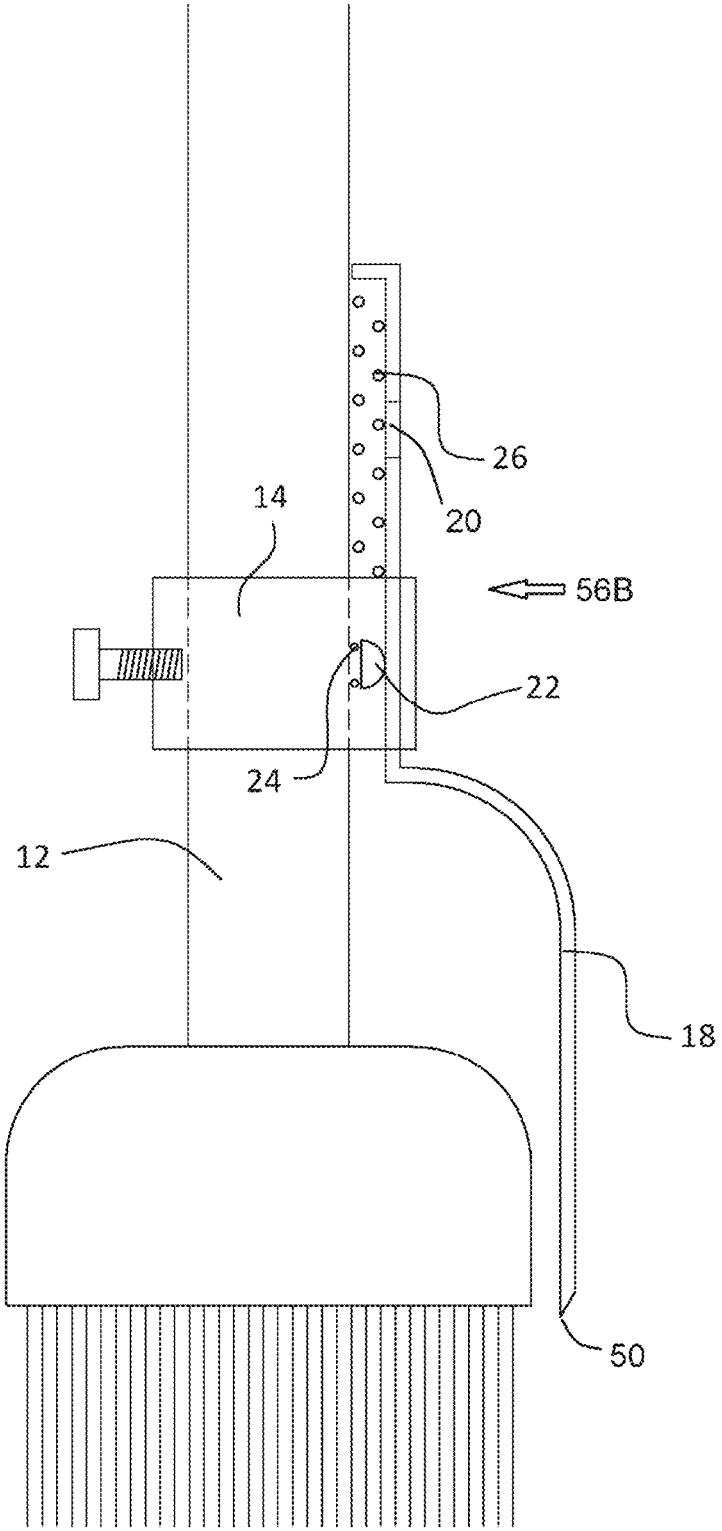
FIG. 4 is the side view of FIG. 2 upon lifting the scraping tip.

FIG. 4 is the side view of FIG. 2 upon lifting the scraping tip.

Upon pressing bolt 22, spring 26 lifts bar 18.

Figure 5:
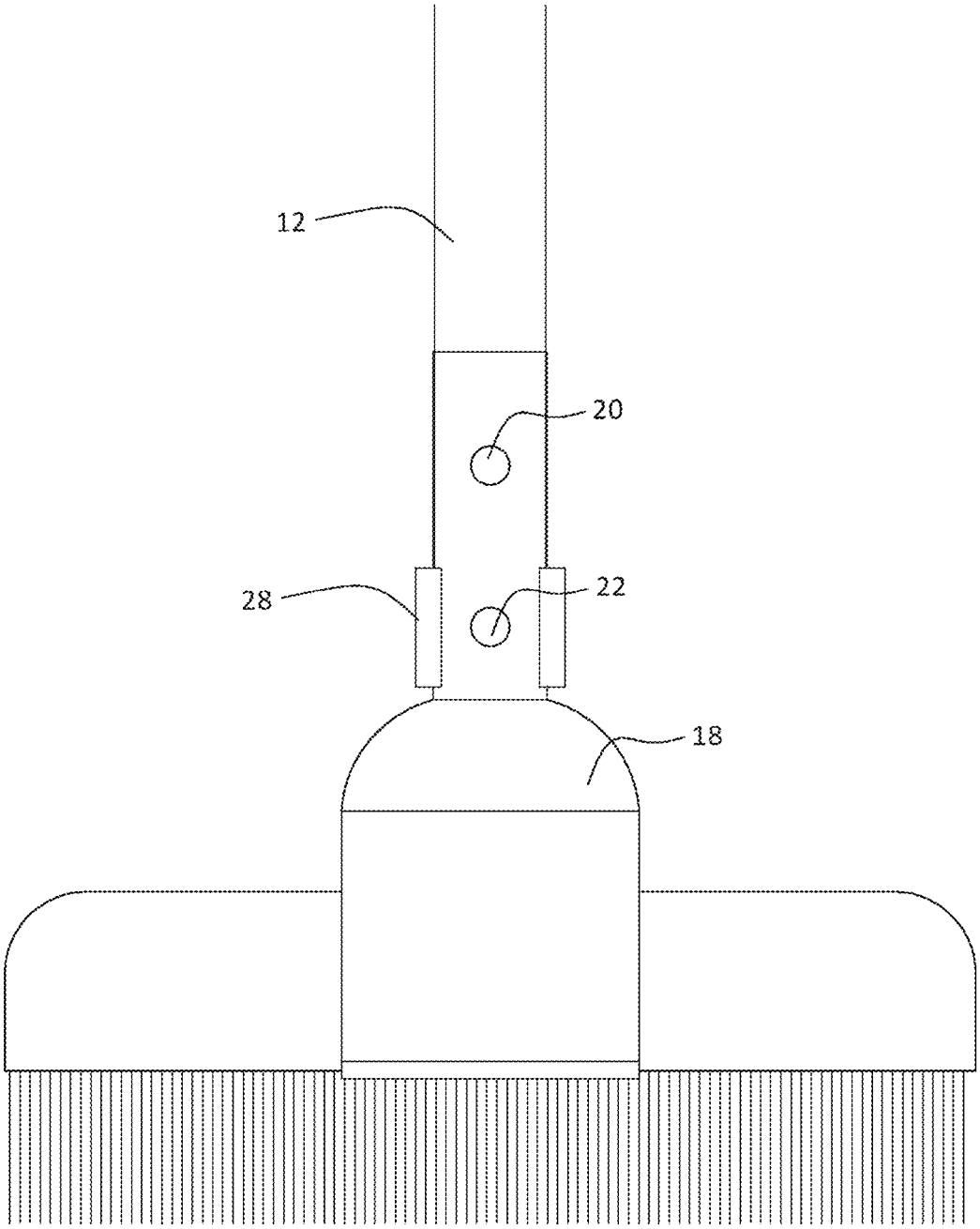
FIG. 5 is front view of FIG. 4.

FIG. 5 is front view of FIG. 4.

Figure 6:
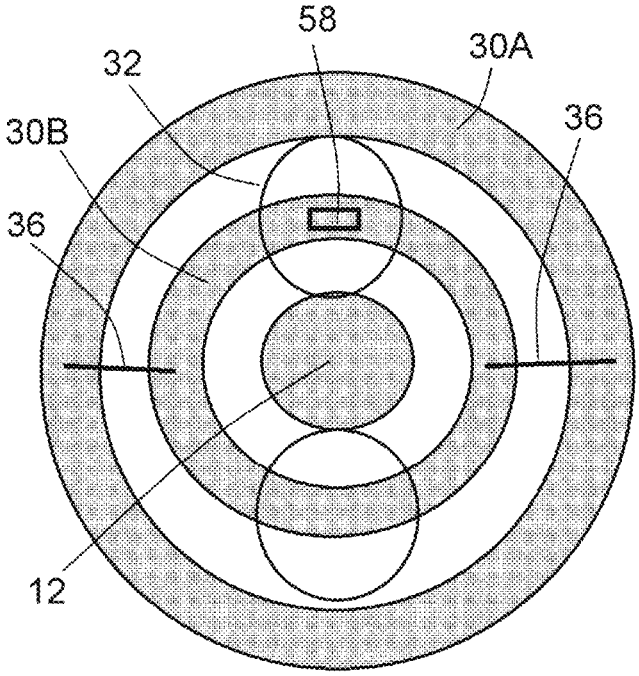
FIG. 6 is a top view of disposition mechanism according to another embodiment, being connected to the broom of FIG. 2.

FIG. 6 is a top view of disposition mechanism according to another embodiment, being connected to the broom of FIG. 2.

A location disposition mechanism 56C includes an external hollow cylinder 30A, functioning as a cart as including wheels 32, for allowing free sliding 66 of hollow cylinder 14 along broom stick 12; and an internal hollow cylinder 30B, being pivotally connected by a hinge 36 to external cylinder 30A.

Thus internal hollow cylinder 30B is tiltable (not shown in FIG. 4) in relation to external hollow cylinder 30A.

Figure 7:
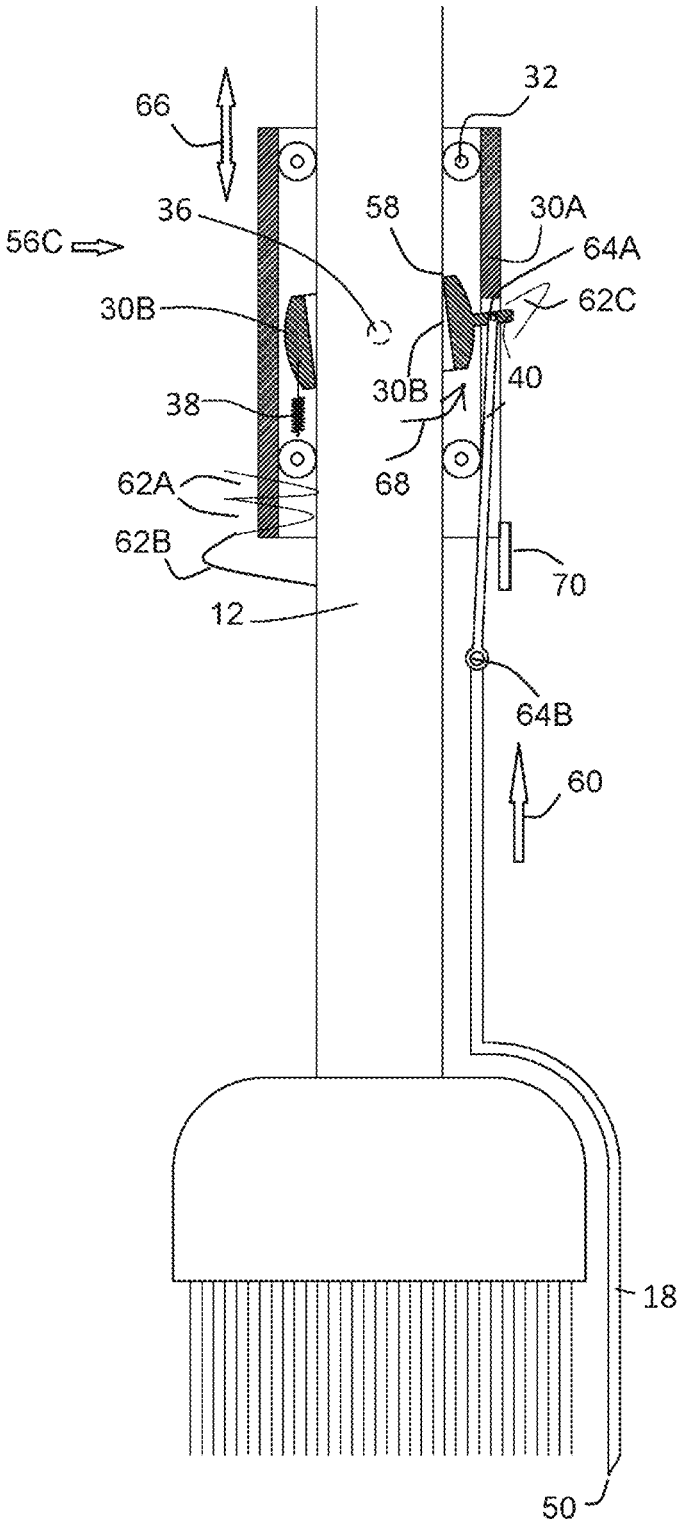
FIG. 7 is a side view of the scraping apparatus of FIG. 1 having the disposition mechanism of FIG. 4, being connected to the broom of FIG. 2.

FIG. 7 is a side view of the scraping apparatus of FIG. 1 having the disposition mechanism of FIG. 4, being connected to the broom of FIG. 2.

Location disposition mechanism 56C further includes a spring 38 for normally tilting, as shown by arrow 68, internal cylinder 30B, as shown in FIG. 5. The internal side of internal cylinder 30B includes insoles 58, for producing friction force with broom stick 12.

Bar 18 is pivotally connected by a hinge 64A to internal cylinder 30B and extends therefrom. Thus, upon scraping, bar 18 is lifted by the floor, and the lifting is converted to rotate internal cylinder 30B, thus increasing the friction pressure of insole 58 on broom stick 12.

Moving scraping tip 50 is enabled by pressing a handle 40 of internal cylinder 30B against spring 38, being downwards in the example of FIG. 4, and then the user may freely slide external cylinder 30A in relation to broom stick 12.

External cylinder 30A is intended to be surrounded by four fingers 62A and the hand 62B; and handle 40 is intended to be pressed by the thumb 62C.

Thus, in one aspect, the invention is directed to a scraping apparatus (10), including:

a gripping assembly (14), for gripping a stick (12) of a cleaning tool;

a bar (18), extending from the gripping assembly (14), the bar shaped to include a first section (52A) being adjacent and parallel to the broom stick (12), and a second section (52B) being adjacent and parallel to a brush (54) of the broom;

a scraping tip (50) disposed at an end of the bar (18); and a location disposition mechanism (56A,56B,56C), for manually allowing sliding the bar (18) in relation to the broom stick (12) and for manually disallowing the sliding against pressure (60) applied on the scraping tip (50).

The gripping assembly (14) may include:

a first hollow cylinder (30A), allowing free sliding of the external hollow cylinder (30A) in relation to the broom stick (12); and a second hollow cylinder (30B), disposed within the first hollow cylinder (30A) and pivotally connected (36) thereto, thereby being tiltable (68) in relation thereto, wherein the bar (18) extends (64A) from the second hollow cylinder (30B), thereby scraping by the scraping tip (50) presses (60) the bar (18) to tilt (68) the second hollow cylinder (30B) to attach to the broom stick (12), thereby producing friction force therebetween against the free sliding therebetween, thereby providing the disallowing of the sliding of the bar (18) in relation to the broom stick (12) against the pressure (60).

The gripping assembly (14) may further include:

a spring (38), for normally tilting the second hollow cylinder (30B) in relation to the first hollow cylinder (30A), thereby normally producing the friction force between the second hollow cylinder (30B) and the broom stick (12).

The gripping assembly (14) may further include:

a handle (40) for pressing thereof against the spring (38), for cancelling the normal tilting of the second hollow cylinder (30B), thereby allowing canceling the friction force between the second hollow cylinder (30B) and the broom stick (12), for providing the free sliding therebetween.

The second hollow cylinder (30B) may include an insole (58), for producing the friction force.

The second hollow cylinder (30B) may include wheels (32), for providing the free sliding of the external hollow cylinder (30A) in relation to the broom stick (12).

The extension of the bar (18) from the second hollow cylinder (30B) may constitute a pivotal connection therebetween applied by a first hinge (64A), thereby providing the tilt (68) of the second hollow cylinder (30B) by the pressing (60) of the bar (18).

The bar (18) may include a second hinge (64B), for compensating over rotation provided by the first hinge (64A).

In the figures and/or description herein, the following reference numerals (Reference Signs List) have been mentioned:

numeral 10 denotes the scraping apparatus according to one embodiment of the invention;

12: broom stick;

14: gripping assembly;

16: screw;

18: bar, for physically communicating scraping tip 50 to gripping assembly 14;

20: hole for housing bolt 22;

22: bolt;

24: horizontal spring;

26: vertical spring;

28: rail;

30A; external hollowed cylinder;

30B; internal hollowed cylinder;

32: wheel/bearing;

36: horizontal hinge;

38: vertical spring;

50: scraping tip;

52A,52B: sections of bar 18;

54: brush or squeegee;

56A,56B,56C: location disposition mechanisms, for allowing the user to vertically locate scraping tip 18;

58: insole;

60: pressure applied by scraping tip 50;

62A: fingers;

62B: hand;

62C: thumb;

64A,64B: hinges;

66: manual vertical sliding, being enabled by pressing handle 40 or by pressing bolt 22;

68: tilting;

70: wall for limiting rotation provided by hinge 64B between sections of bar 18.

The foregoing description and illustrations of the embodiments of the invention have been presented for the purpose of illustration, and are not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A scraping apparatus, comprising:

a gripping assembly, for gripping a stick of a cleaning tool;

a bar, extending from said gripping assembly, said bar shaped to comprise a first section being adjacent and parallel to said stick, a second section being adjacent and parallel to a brush of the cleaning tool extending outwards from said stick, said second section lacking any element disposed between said second section and said stick, a scraping tip disposed at said end of said bar, thereby said scraping tip is disposed aside said stick and said brush, and a third section being tilted in relation to said first and second sections and extending therebetween; and a location disposition mechanism, for manually allowing sliding said bar in relation to said stick and for manually disallowing said sliding against pressure applied on said scraping tip, wherein said gripping assembly comprises a first hollow cylinder, allowing free sliding of said external hollow cylinder in relation to said stick, and a second hollow cylinder, disposed within said first hollow cylinder and pivotally connected thereto, thereby being tiltable in relation thereto, wherein said bar extends from said second hollow cylinder, thereby scraping by said scraping tip presses said bar to tilt said second hollow cylinder to attach to said stick, thereby producing friction force therebetween against said free sliding therebetween, thereby disallowing said sliding of said bar in relation to said stick against pressure applied on said scraping tip.

2. The scraping apparatus according to claim 1, wherein said gripping assembly further comprises:

a spring, for normally tilting said second hollow cylinder in relation to said first hollow cylinder, thereby normally producing said friction force between said second hollow cylinder and said stick.

3. The scraping apparatus according to claim 2, wherein said gripping assembly further comprises:

a handle for pressing thereof against said spring, for cancelling said normal tilting of said second hollow cylinder, thereby allowing canceling said friction force between said second hollow cylinder and said stick, for providing said free sliding therebetween.

4. The scraping apparatus according to claim 1, wherein said second hollow cylinder comprises an insole, for producing said friction force.

5. The scraping apparatus according to claim 1, wherein said second hollow cylinder comprises wheels, for providing said free sliding of said external hollow cylinder in relation to said stick.

6. The scraping apparatus according to claim 1, wherein said extension of said bar from said second hollow cylinder comprises a pivotal connection therebetween applied by a first hinge, thereby said pivotal connection tilts said second hollow cylinder to attach to said stick.

7. The scraping apparatus according to claim 6, wherein said bar comprises a second hinge, for compensating over rotation provided by said first hinge.

* * * * *